United States Patent [19]

Granieri

[11] Patent Number: 4,750,306

[45] Date of Patent: Jun. 14, 1988

[54] CONCRETE FOUNDATION SLAB ANCHORING SYSTEM FOR MODULAR ELEMENTS OF A BUILDING STRUCTURE

[76] Inventor: Luigi Granieri, SS.33 bis, 06050 Pantalla/PG, Italy

[21] Appl. No.: 52,157

[22] Filed: May 18, 1987

Related U.S. Application Data

[63] Continuation of Ser. No. 810,592, Dec. 19, 1985, abandoned.

[51] Int. Cl.[4] ..... E02D 27/00

[52] U.S. Cl. ..... 52/251; 52/295

[58] Field of Search ..... 52/251, 293, 294, 295, 52/236.7, 236.8, 236.9

[56] References Cited

U.S. PATENT DOCUMENTS

| | | | |
|---|---|---|---|
| 2,249,204 | 7/1941 | Guignon, Jr. | 52/293 |
| 2,691,293 | 10/1954 | Patterson | 52/295 |
| 3,190,041 | 6/1965 | Kimball | 52/294 |
| 3,334,455 | 8/1967 | Russell | 52/294 |
| 3,566,560 | 3/1971 | Wakefield et al. | 52/236.7 |
| 3,585,771 | 6/1971 | Pinniger | 52/251 |

FOREIGN PATENT DOCUMENTS

| | | | |
|---|---|---|---|
| 1234765 | 10/1960 | France | 52/236.7 |

*Primary Examiner*—John E. Murtagh
*Assistant Examiner*—Caroline D. Dennison
*Attorney, Agent, or Firm*—Stevens, Davis, Miller & Mosher

[57] ABSTRACT

An anchoring system providing a rod iron cage placed along the periphery of the walls and designed to be the reinforcement cage of a perimetrical sill, a first metal channel section having downward divergent flanges and being supported by the cage in order to provide a locating template for the sill and for the levelling of the foundation slab and at the same time to keep the anchoring hooks of the tie rods hanging within the cage till the sill is cast. The tie rods extend within and along vertical ducts defined between the vertical profiles of two panels approaching each other. A second channel section is fastened to the locating template on the upper side of the first channel section to provide both a perimetrical datum line and a restrained joint between the panels and the slab. The channel section has dimensions such as to be received into the groove provided in the lower surface of the applied panels.

2 Claims, 2 Drawing Sheets

Figure 1:
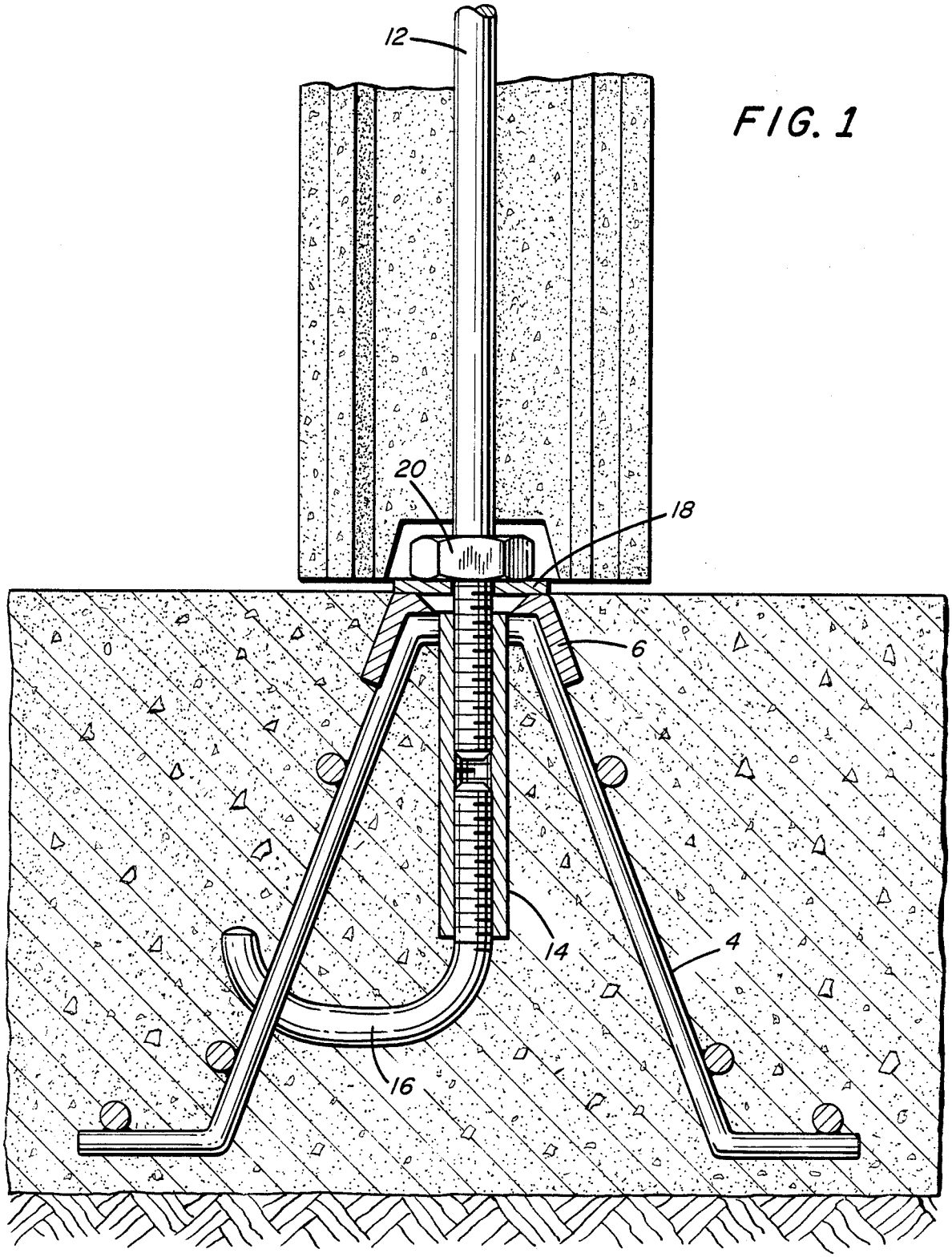

CONCRETE FOUNDATION SLAB ANCHORING SYSTEM FOR MODULAR ELEMENTS OF A BUILDING STRUCTURE

This application is a continuation of application Ser. No. 810,592 filed Dec. 19, 1985, now abandoned.

DESCRIPTION

The present invention relates to a new and improved device for anchoring precast panels to the concrete foundation slab by means of tie rods.

In the Italian Patent Application No. 47988A/83 of the same applicant a building structure is disclosed which is based on a concrete foundation slab and is provided with walls made of prefabbricated reinforced concrete panels, at the upper side of which metal channel sections are embedded, said panels being fastened to one another by means of bolts connecting the vertical extension of metal plates anchored to said metal channel sections. Said panels are anchored to the foundation slab of the building structure by means of vertical tie rods hooked at their lower ends to reversed T-shaped sections anchored to the foundation plates and connected at their upper end by means of a nut to said panel connecting metal plates. Such tie rods extend along vertical ducts which are defined, in case of two approached panels, by metallic channel sections which are embedded into the vertical edge of each panel.

The reversed T-shaped section is laid on the slab along the periphery of the walls and in turn anchored by means of brackets embedded into the concrete slab.

In practice during the construction of the foundation slab such an anchoring system caused several problems due to the anchoring brackets of the T-shaped section and the accurate placing of the latter.

The present invention seeks to provide an easy installation of the panels, achieve a reliable and quick fastening of the components and to make easier their assembly and set up.

To this end the claimed anchoring system provides:

a rod iron cage placed along the periphery of the walls and designed to be the reinforcement cage of a perimetrical sill;

a first metal channel section having downward divergent flanges and being supported by said cage in order to provide a locating template for the sill and for the levelling of the foundation slab and at the same time to keep the anchoring hooks of the tie rods hanging within the cage till the sill is cast;

a second channel section to be fastened to said locating template on the upper side of the first channel section. Thus providing both a perimetrical datum line and a restrained joint between the panels and the slab, said channel section having such dimensions as to be received into the groove provided in the lower surface of said panels.

According to a feature of the present invention the anchoring hooks of the tie rods are fastened to the locating template as follows: a plurality of holes spaced from one another at a distance equal to the length of the panels under assembled conditions are bored through the upper horizontal side of the locating template; inside threaded sleeves passing through the holes and vertically extending downwardy within the cage are fastened at their upper ends to the locating template by means of screws and are screwed at their lower ends to the threaded ends of the panel anchoring hooks. After levelling the foundation slab only the locating template with the screws connecting the sleeves is visible. After removing the screws from the sleeves the second channel section is laid on the first channel section and the threaded ends of the panel anchoring tie rods are screwed into the threaded holes of the sleeves, whereupon the second channel section is tightened to first channel section by means of nuts engaging the threaded ends of the tie rods.

Figure 2:
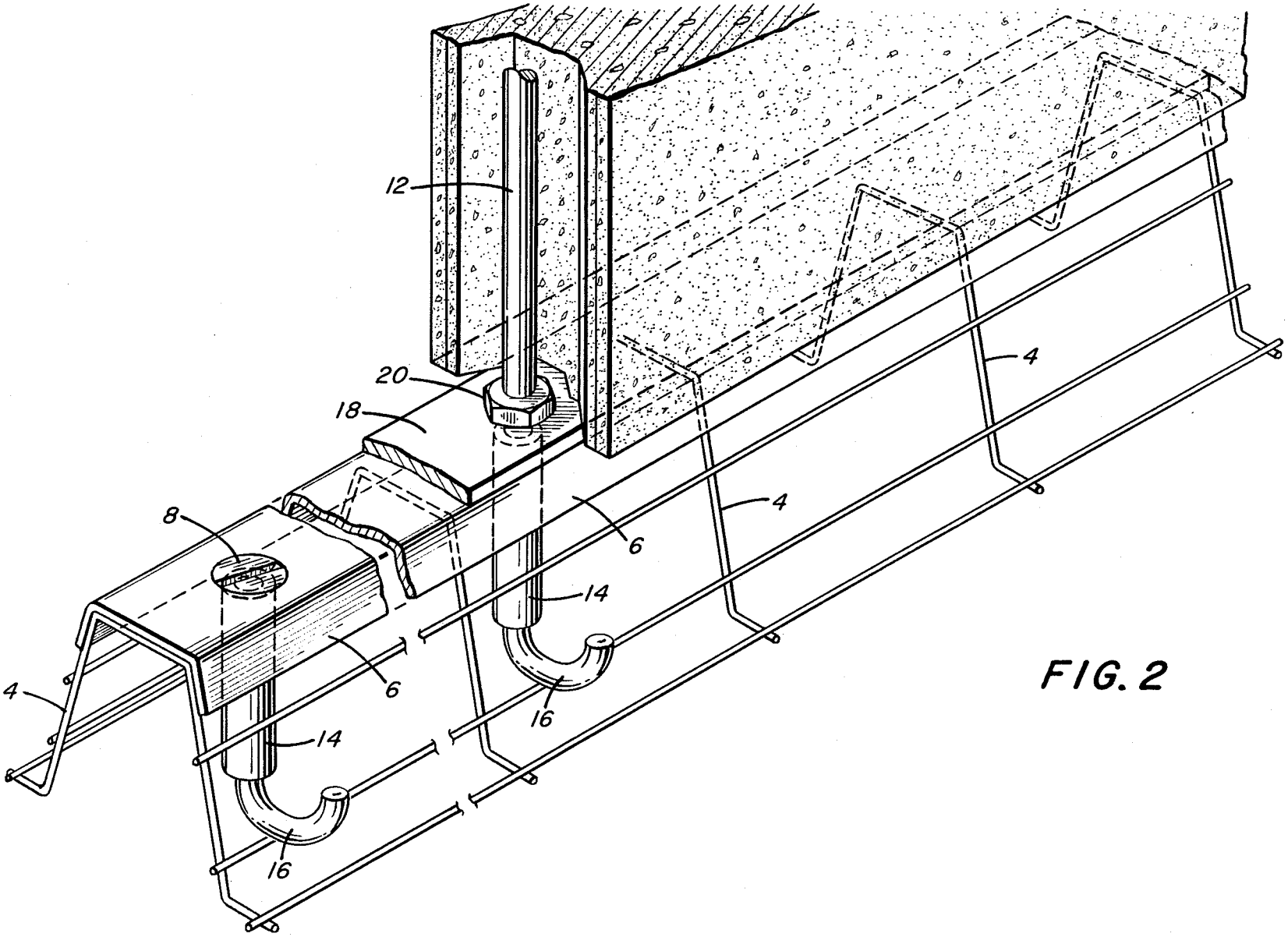

Further features of this invention will be more readily apparent from the following description with reference to the accompanying drawings, in which:

FIG. 1 is a front view of the cage with the hook connected to a tie rod; and FIG. 2 is a perspective view of a panel during the assembly on the channel section anchored to the slab.

With reference to the figures, the cage 4 is the reinforcement structure of a sill which is cast along the periphery of the foundation slab. On the cage 4 a reversed metal channel section 6 with downward diverged flanges is laid, through-holes spaced from one another at a distance equal to the length of a panel being bored at the upper, horizontal side of said channel section 6. Inside threaded sleeves 14 passing through said holes and vertically hanging within the cage are fastened at their upper ends to the metal channel section 6 by means of screws 8 and are screwed at their lower ends to the anchoring hooks 16. The diameter of the through-holes of the locating template and the diameter of the sleeves allow the lower threaded ends of the tie rods 12 to be passed through the holes and to be screwed to the sleeves. After placing the form-works up to the height of the metal channel section 6 all around the periphery of the slab the casting of a perimetrical sill acting as locating means and afterwards the casting of the whole concrete slab is carried out including the cage 4, the flanges of the channel section 6, the sleeves 14 and the hooks 16. When the casting is set the screws 8 plugging the treaded sleeves to prevent the accidental filing thereof are removed.

A channel section 18, which is provided like the channel section 6 with through-holes for the tie rods 12 to be screwed into the sleeves 14, is placed along the whole extension of the channel section 6 at the same level as the surface of the concrete slab. The channel section 18 is anchored to the channel section 6 by means of nuts 20 screwed at the lower threaded ends of the tie rods 12 which in turn are screwed into the upper ends of the sleeves 14.

I claim:

1. In an anchoring means for a building foundation slab of a wall made of modular panels of rectangular form having all the same thickness and height equal to the distance between the floor and the ceiling of a building story, said panels being provided with a channel extending along the lower edge of each panel and along both sides thereof with vertical profiles; adjacent panels forming a vertical duct said panels being anchored to said slab by means of tie rods extending within said ducts and connected at the lower end thereof with anchoring hooks engaged in said building slab, the improvement of said anchoring means comprising a rod iron cage embedded into said building slab along and under the lower perimetrical edge of said building walls for reinforcing the building slab under said wall panels and making a sill for the same; a first metal channel section in the form of a reversed channel section with downward diverging flanges placed on top of said cage for levelling the concrete slab and as a support for said anchoring hooks, said first channel section being provided with a through hole located between each pair of adjacent panels.

2. The anchoring means for a building structure as set forth in claim 1 including a second metal channel section laid on top and along said first metal channel section and defining as many through holes as said first metal channel, said second metal channel section having a U cross-section with upwardly directed slightly converging flanges, said cross section being adapted for fitting into said lower channel extending along the lower edges of said panels.

* * * * *